US005484235A

United States Patent [19]

Hilfiker et al.

[11] Patent Number: 5,484,235

[45] Date of Patent: Jan. 16, 1996

[54] RETAINING WALL SYSTEM

[76] Inventors: William K. Hilfiker, 3718 Lakeridge Dr., Grapevine, Tex. 76051; Thomas P. Taylor, 2500 Cranberry La., Euless, Tex. 76039

[21] Appl. No.: 252,738

[22] Filed: Jun. 2, 1994

[51] Int. Cl.[6] ..... E02D 29/02

[52] U.S. Cl. ..... 405/284; 52/611; 52/605; 405/262; 405/286

[58] Field of Search ..... 405/258, 262, 405/273, 284, 285, 286; 52/605, 606, 607, 608, 609, 610, 611

[56] References Cited

U.S. PATENT DOCUMENTS

| | | | |
|---|---|---|---|
| Re. 13,299 | 10/1911 | Denison | 52/611 |
| 1,813,912 | 7/1931 | Clark | 52/606 |
| 1,959,816 | 5/1934 | Crum | 52/606 |
| 1,992,785 | 2/1935 | Steuer | 52/605 |
| 2,275,933 | 3/1942 | Werner | 52/608 |
| 2,552,712 | 5/1951 | Ellis | 52/606 |
| 2,881,614 | 4/1959 | Preininger | 52/608 |
| 3,998,022 | 12/1976 | Muse | 52/574 |
| 4,117,686 | 10/1978 | Hilfiker | 405/284 |
| 4,123,881 | 11/1978 | Muse | 52/100 |
| 4,324,508 | 4/1982 | Hilfiker et al. | 405/284 |
| 4,329,089 | 5/1982 | Hilfiker et al. | 405/262 |
| 4,411,255 | 10/1983 | Lee | 126/429 |
| 4,653,962 | 3/1987 | McKittrick et al. | 405/286 |
| 4,661,023 | 4/1987 | Hilfiker | 405/262 |
| 4,834,584 | 5/1989 | Hilfiker | 405/262 |
| 4,920,712 | 5/1990 | Dean, Jr. | 52/169.4 |
| 4,993,879 | 2/1991 | Hilfiker | 405/262 |
| 5,076,735 | 12/1991 | Hilfiker | 405/258 X |
| 5,257,880 | 11/1993 | Janopaul, Jr. | 405/286 X |

OTHER PUBLICATIONS

Section 02276/Key/BuyLine 2802, "Keystone Retaining Wall Systems," Sweet's Engineering and Retrofit: Mechanical, Electrical, Civil/Structural 1993 Catalog File, published by McGraw–Hill (1993).

Section 02276/Roc/BuyLine 6342, "Rockwood Retaining Wall Systems," Sweet's Engineering and Retrofit: Mechanical, Electrical, Civil/Structural 1993 Catalog File, published by McGraw–Hill (1993).

Section 02276/GRB/BuyLine 6579, "Gravity Retaiing Walls Incorporated," Sweet's Engineering and Retrofit: Mechanical, Electrical, Civil/Structural 1993 Catalog File, published by McGraw–Hill (1993).

Section 0276/AND/Buyline 7682, "Diamond, The Pinless System," Sweet's Engineering and Retrofit: Mechanical, Electrical, Civil/Structural 1993 Catalog File, published by McGraw–Hill (1993).

Sweet's Engineering and Retrofit: Mechanical, Electrical, Civil/Structural 1993 Catalog File, published by McGraw–Hill (1993), Section 02276/(KEY, ROC, GRB and AND) (Earth Retainage, Buylines 2802 (Keystone), 6342 (Rockwood), 6578 (Gravity) and 7682 (Diamond).

*Primary Examiner*—Dennis L. Taylor
*Attorney, Agent, or Firm*—Limbach & Limbach

[57] ABSTRACT

A retaining wall system including a wall portion interconnected with welded wire mat and secured in position is disclosed. The wall may be composed of a plurality of modular blocks, preferably made of concrete, having grooves into which individual wires of the welded wire mat are placed. Examples of modular blocks disclosed are concrete S, T and J-blocks. Alternately, the wall may be a concrete panel. One embodiment of the present invention employs a concrete shaft placed into the soil behind the wall and to which the welded wire mats are secured to hold the wall in place.

21 Claims, 9 Drawing Sheets

RETAINING WALL SYSTEM

FIELD OF THE INVENTION

The present invention relates to a retention system for earthen formations. More specifically, the present invention relates to a retention system utilizing modular concrete blocks that are interconnected by welded wire components. The present invention also relates to a retention system suitable for use in areas where little room is available for mechanically stabilizing the wall, such as those areas where right-of-way restrictions exist near the wall.

BACKGROUND OF THE INVENTION

A number of retaining walls have been known in the prior art. Examples of such retaining wall structures are shown in U.S. Pat. Nos. 4,123,881 and 4,324,508.

U.S. Pat. No. 4,123,881, discloses a wall structure assembled from horizontal courses of T-shaped building blocks. The blocks in the first course are tied together using U-shaped clips. As the wall increases in height, tie rods are inserted vertically through the courses of blocks to tie the blocks in adjacent courses together.

U.S. Pat. No. 4,324,508, coinvented by William K. Hilfiker, one of the coinventors herein, teaches a retaining and reinforcement system using welded wire grid mats that are secured to precast elongate panels disposed at the face of an earthen formation. The mats reinforce the earthen formation against slippage. The panels are provided with a plurality of holes at the upper and lower surfaces through which pin members are vertically passed. The mats are folded over at their distal ends in the shape of loops through which rods are horizontally passed. The vertical pins are extended behind the horizontal rods to secure the mats to the precast elongate panels.

SUMMARY OF THE INVENTION

The present invention is directed toward a retaining wall system that is easy to assemble and can be built even in areas providing little room for mechanical stabilization.

One aspect of the present invention is directed toward an improved segmental retaining wall system that includes a plurality of modular concrete blocks that are interconnected to various welded wire components, which may be in the form of mats, to form an integrated retaining wall system.

A principal object of this aspect of the present invention is to provide a retaining wall system that employs a hollow concrete block in which a welded wire reinforcement is placed in such a manner as to form a connector.

A second object is to create an easily manipulated modular precast concrete unit that could be used in all earth retaining situations by modification of the welded wire connector.

A third object is to create a retaining wall system that would decrease the volume of select fill that is needed.

A fourth object is to develop a segmental block system that could apply standard masonry design principles.

A fifth object is to create a retaining wall that is easy to manufacture.

A sixth object is to provide a newer, faster, and more improved method for erecting retaining walls.

These and other objects of this aspect of the present invention are achieved by providing a retaining wall as follows. A plurality of modular blocks are assembled in rows and are vertically stacked. Each modular block is provided with a transverse groove formed in its top surface. A welded wire component is attached to certain ones of the plurality of modular blocks. The welded wire component is provided with a plurality of longitudinal and transverse wires. Attachment is made possible by the interconnection of one or more of the transverse wires with the transverse groove of each of the certain ones of the plurality of modular blocks.

An advantage of the system according to this aspect of the present invention is that it is conducive to cut and fill site conditions. More generally, this system can be used in conjunction with soil nailed, rock anchor gabion (gravity walls), drilled shaft (veneer applications), cantilevered and reinforced soil applications.

Also, the interconnection between the welded wire component and the modular blocks integrates the weld shear of the transverse wire, the concrete block channel and the core medium. The reinforcement also supplies horizontal shear support to the wall system.

Additionally, the modular blocks may be placed back to back in number of different ways and have their hollow portions filled with some medium so that the resulting structure can become a large mass. The blocks are shaped for added versatility in arrangement.

Yet another advantage is that the number of parts necessary to erect the retaining wall according to the present invention would be greatly reduced.

Another aspect of the present invention is to provide a shaft behind a wall structure to which the welded wire components may be secured. This would provide stability in areas where little room is available.

Other objects, advantages and features of the present invention will be apparent in view of the Figures and the detailed description.

DETAILED DESCRIPTION OF THE PREFERRED EMBODIMENTS

Figure 1:
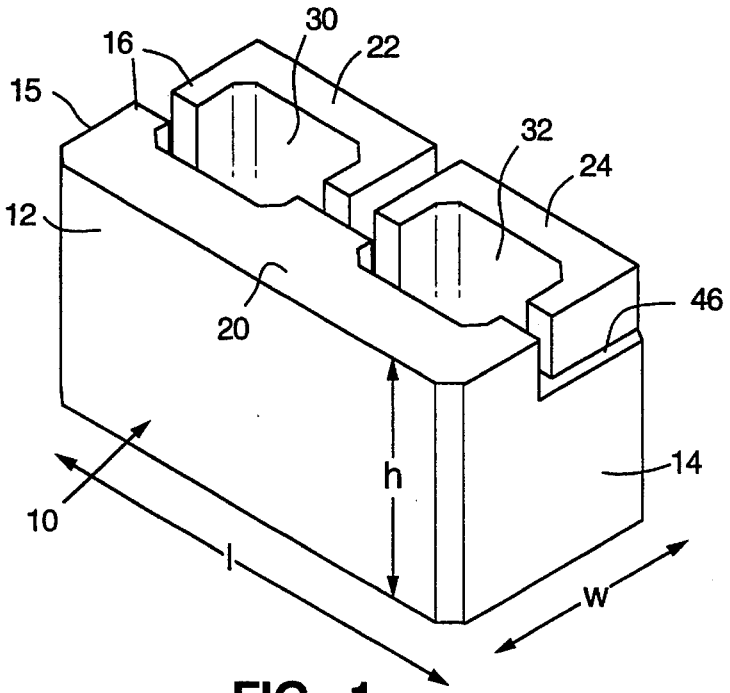
FIG. 1 illustrates a perspective view of a modular S-block according to a first embodiment of the present invention.
Figure 2:
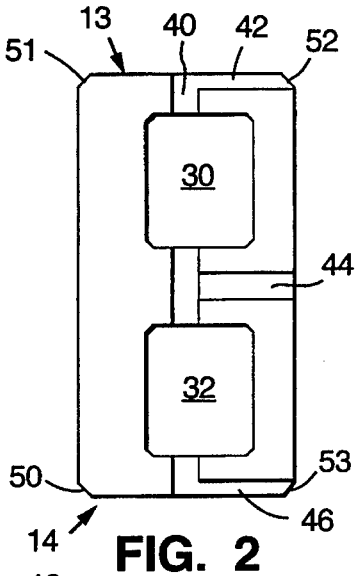
FIG. 2 illustrates a top view of the block of FIG. 1.
Figure 3:
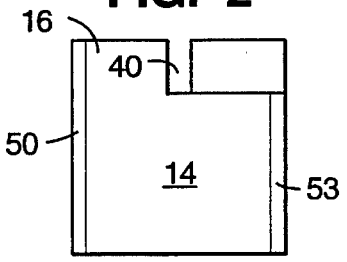
FIG. 3 illustrates a side view of the block of FIGS. 1 and 2.

FIGS. 1–3 show a modular S-block (block 10) according to a first embodiment of the present invention. Block 10 is a precast concrete block having a front face 12, a pair of side faces 14 and 15, and a top face 16. Block 10 is generally rectangular in shape with a width (w), height (h) and length (l). In a preferred embodiment, width (w) and height (h) each equal 8 inches and length (l) is equal to 16 inches. Of course, any size block could be used. Top face 16 is provided with an E-shaped portion 20 and a pair of C-shaped portions 22 and 24. Each C-shaped portion (22, 24) is approximately one-half the length of the E-shaped portion 20 and is disposed facing the E-shaped portion 20, thereby forming hollow portions 30 and 32. Hollow portions 30 and 32 extend throughout the entire height (h) of block 10. These hollow portions are also referred to as cores.

This arrangement also defines a plurality of channels 40, 42, 44 and 46. Channel 40 is a transverse channel that extends between E-shaped portion 20 and the C-shaped portions 22 and 24. Channel 40, like all of the remaining channels, preferably extends to a depth of approximately one-fourth (or two inches in the preferred embodiment) the height (h) of block 10, except where the channel 40 passes through hollow portions 30 and 32. Channel 44 is perpendicular to and intersects with channel 40. Channel 44 separates the two C-shaped sections 22 and 24. Channels 42 and 46 are formed along the side faces 15 and 14, respectively, of block 10. Channels 42 and 46 intersect and are perpendicular to channel 40.

If desired, the corners of block 10, as viewed from the top in FIG. 2, may be chamfered so as to form indented sections 50, 51, 52 and 53. It is to be understood that various types of indentations could be used and that the type shown in FIGS. 1–3 is by way of example only.

Figure 4:
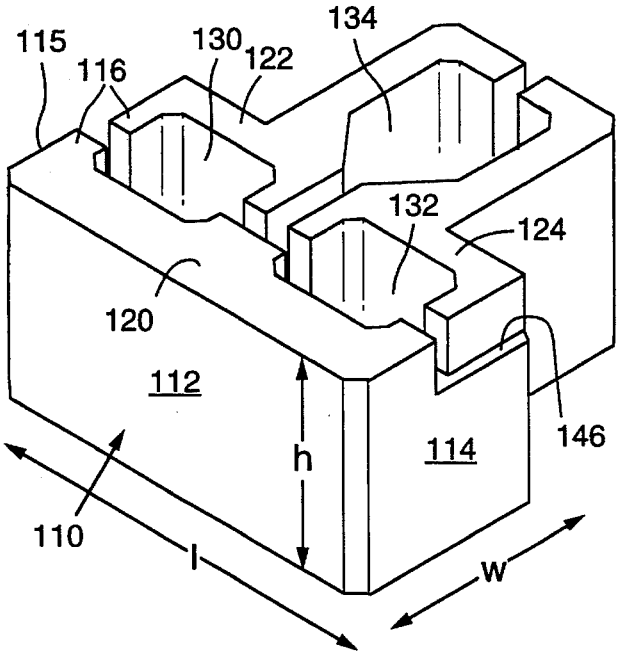
FIG. 4 illustrates a perspective view of a modular T-block according to a second embodiment of the present invention.
Figure 5:
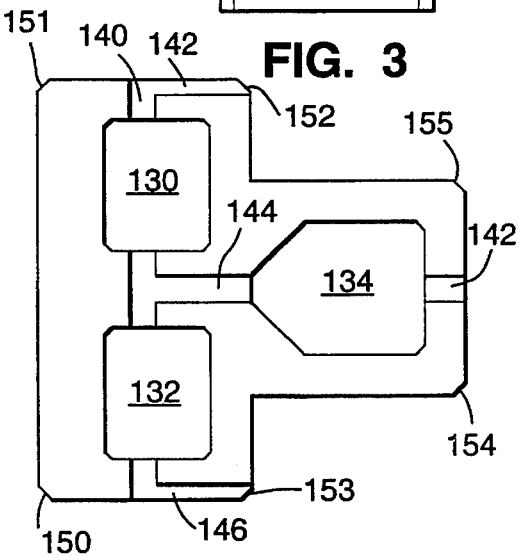
FIG. 5 illustrates a top view of the block of FIG. 4.
Figure 6:
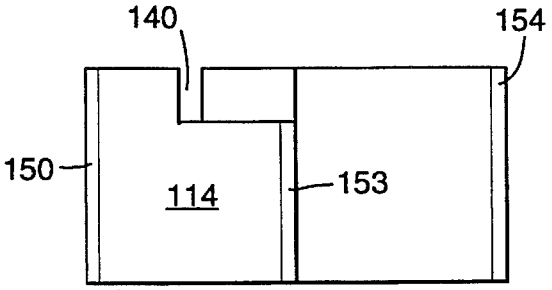
FIG. 6 illustrates a side view of the block of FIGS. 4 and 5.

FIGS. 4–6 illustrate a modular T-block 110 according to a second embodiment of the present invention. Block 110 is a precast concrete block having a front face 112, a pair of side faces 114 and 115, and a top face 116. Block 110 has a generally rectangular front section with a width (w), height (h) and length (1). Top face 116 is provided with an E-shaped portion 120 and a pair of Y-shaped portions 122 and 124. Each Y-shaped portion (122, 124) extends perpendicularly from the E-shaped portion 120 such that the head of each Y-shaped portion (122, 124) combines with the E-shaped portion 120 to form hollow portions 130 and 132. Hollow portions 130 and 132 extend throughout the entire height (h) of block 110.

Each Y-shaped portion (122, 124) is provided with a tail portion which are mirror images of one another. In other words, the tail of Y-shaped section 122 is shaped to resemble a mirror image of the tail of Y-shaped section 124. These tail portions, of section 122 and 124, are arranged so that they face one another to form another hollow portion 134, which also extends throughout the entire height (h) of the block.

The arrangement shown in FIGS. 4–6 also defines a plurality of channels 140, 142, 144, 146, and 148. Channel 140 is a transverse channel that extends between E-shaped portion 20 and the heads of the Y-shaped portions 122 and 124. Channel 140, like all of the remaining channels, preferably extends to a depth of approximately one fourth (or two inches in the preferred embodiment) the height (h) of block 110, except where the channel 140 passes through hollow portions 130 and 132. Channel 144 is perpendicular to and intersects with channel 140. Channel 144 separates the two Y-shaped sections 122 and 124. Channels 142 and 146 are formed along the side faces 115 and 114, respectively, of block 110. Channels 142 and 146 intersect and are perpendicular to channel 140.

If desired, the corners of block 110, as viewed from the top in FIG. 5, may be chamfered so as to form indented sections 150, 151, 152, 153, 154 and 155. It is to be understood that various types of indentations could be used and that the type shown in FIGS. 4–6 is by way of example only.

Figure 7:
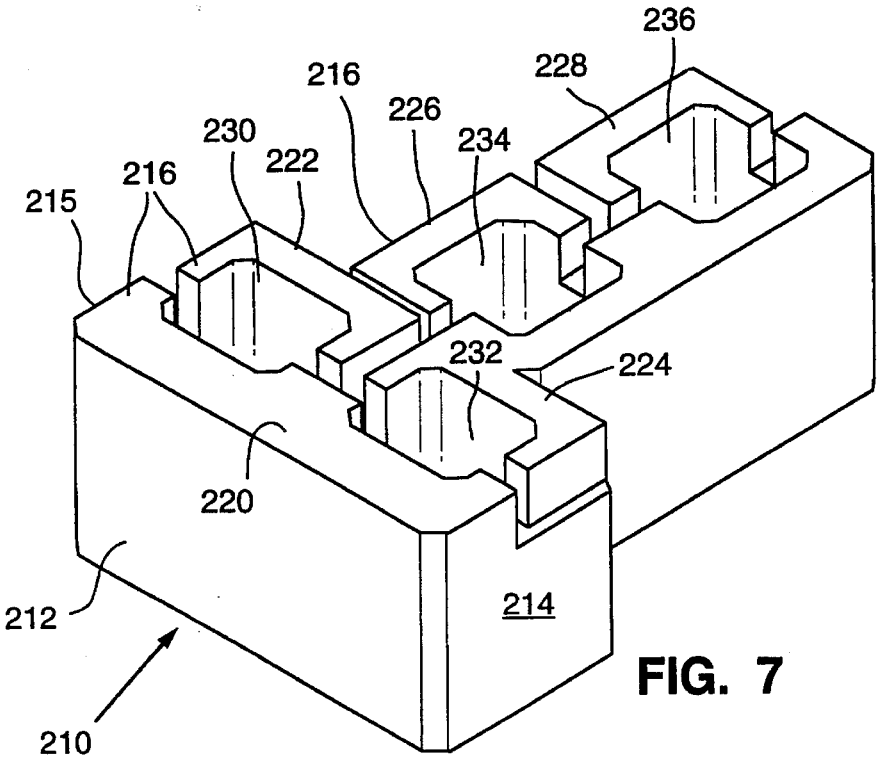
FIG. 7 illustrates a perspective view of a modular J-block according to a third embodiment of the present invention.
Figure 8:
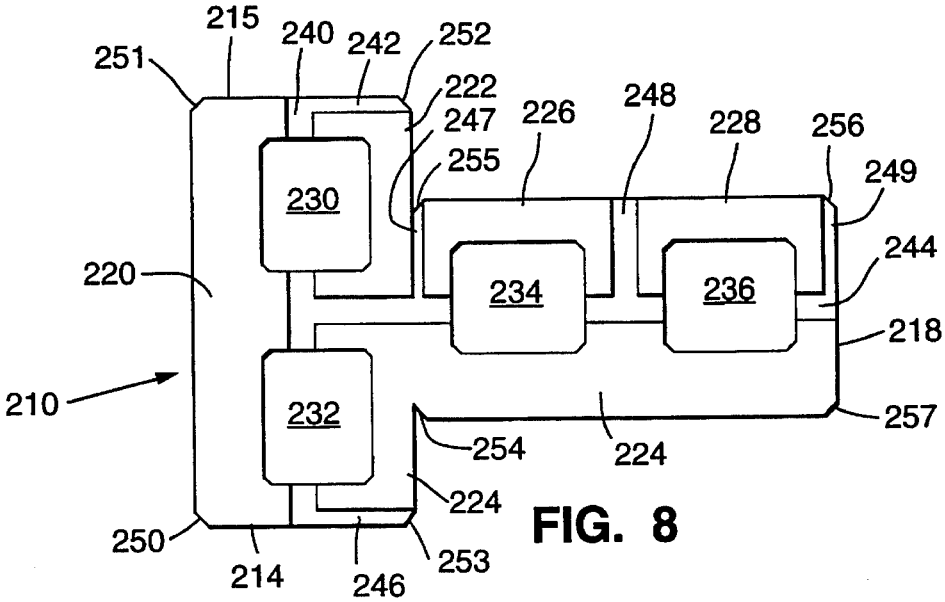
FIG. 8 illustrates a top view of the block of FIG. 7.
Figure 9:
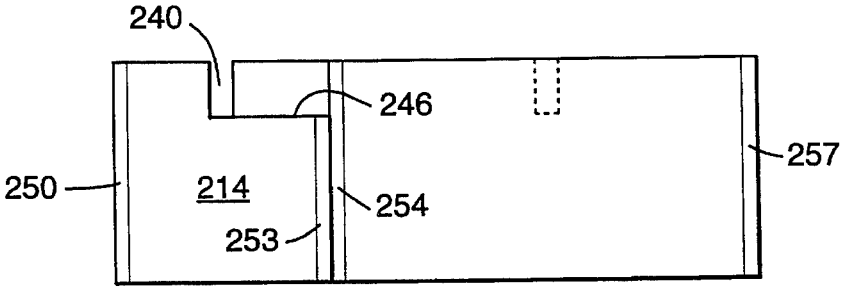
FIG. 9 illustrates a side view of the block of FIGS. 8 and 9.

FIGS. 7–9 illustrate a modular J-block 210 according to a third embodiment of the present invention. Block 210 is a precast concrete block having a front face 212, a pair of side faces 214 and 215, and a top face 216. Block 210 resembles a combination of two S-block, shown in FIGS. 1–3, arranged in the form of a T. Each block of the combination is generally rectangular in shape with a width (w), height (h) and length (l). Top face 216 is provided with an E-shaped portion 220, a Y-shaped portion 224 and three C-shaped portions 222, 226 and 228. The Y-shaped portion 224, unlike Y-shaped portion 124 of FIG. 4, actually resembles a combination of an E-shaped part with a C-shaped part attached at one end. Just as in the first embodiment shown in FIGS. 1–3, portions 220, 222 and 224 combine to define hollow portions 230 and 232. Hollow portions 230 and 232 extend throughout the entire height (h) of block 210.

Furthermore, the E-shaped part of Y-shaped portion 224 combines with C-shaped portions 226 and 228 to define hollow portions 234 and 236, which also extend throughout the entire height (h) of block 210.

The arrangement shown in FIGS. 7–9 also defines a plurality of channels 240, 242, 244, 246, 247, 248 and 249. Channel 240 is a transverse channel that extends between E-shaped portion 220 and both C-shaped portion 222 and the C-shaped part of Y-shaped portion 224. Channel 240, like all of the remaining channels, preferably extends to a depth of approximately one-fourth (or about two inches in the preferred embodiment) the height (h) of block 210, except where the channel 240 passes through hollow portions 230 and 232. Channel 244 is perpendicular to and intersects with channel 240. Channel 244 separates C-shaped section 222 from the C-shaped part of Y-shaped section 224. Channels 242 and 246 are formed along the side faces 215 and 214, respectively, of block 210. Channels 242 and 246 intersect and are perpendicular to channel 240.

Furthermore, channels 247–249 are perpendicular to and intersect with channel 244. Channel 247 separates C-shaped portions 222 and 226. Channel 248 separates C-shaped portions 226 and 228. Channel 249 is formed along a side face 218 of block 210.

If desired, the corners of block 210, as viewed from the top in FIG. 8, may be chamfered so as to form indented sections 250, 251, 252, 253, 254, 255, 256 and 257. It is to be understood that various types of indentations could be used and that the type shown in FIGS. 7–9 is by way of example only.

Figure 10:
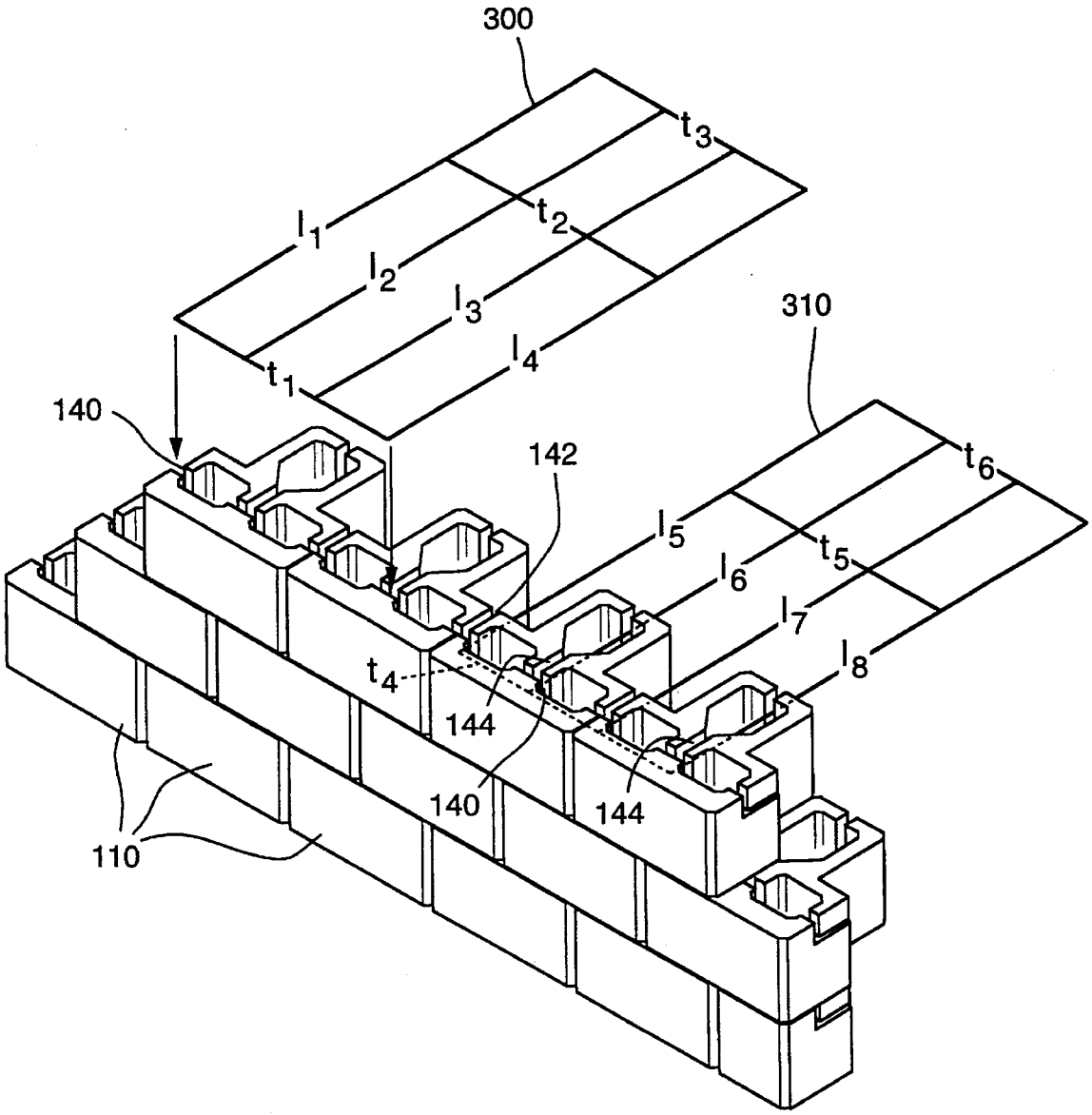
FIG. 10 illustrates a partial, perspective view, with a portion shown in exploded view fashion, of the assemblage of a wall structure using T-blocks according to the second embodiment of the present invention.

FIG. 10 illustrates a partial perspective view of a retaining wall using the modular T-blocks discussed above with respect to the second embodiment of the present invention as depicted in FIGS. 4–7. As shown in FIG. 10, a plurality of blocks, each designated by the numeral 110, are stacked, horizontally, in vertically staggered rows.

Welded wire component 310 is shown interconnected with certain ones of the blocks 110. Welded wire component 300 is shown in exploded fashion above blocks 110. Each of the welded wire components includes a plurality of longitudinal wires ($l_1$–$l_8$) and a plurality of transverse wires ($t_1$–$t_6$). The interconnection between the welded wire component and the blocks 110 occurs as a result of the interlocking of a transverse wire such as $t_4$ within transverse groove 140 of one of the blocks 110. Additionally, longitudinal wires $l_5$, $l_6$ and $l_7$ may interlock with grooves 142, 144, and 146, respectively. While staggered, blocks 110 are vertically arranged so that the hollow portions, or cores, of each of the blocks 110 in each row line up with one another to define a larger hollow portion or core. This larger hollow portion can then be filled with some medium (not shown) for reinforcement. The medium used may be grout, free draining material or steel, for example, depending upon what is needed.

Figure 11:
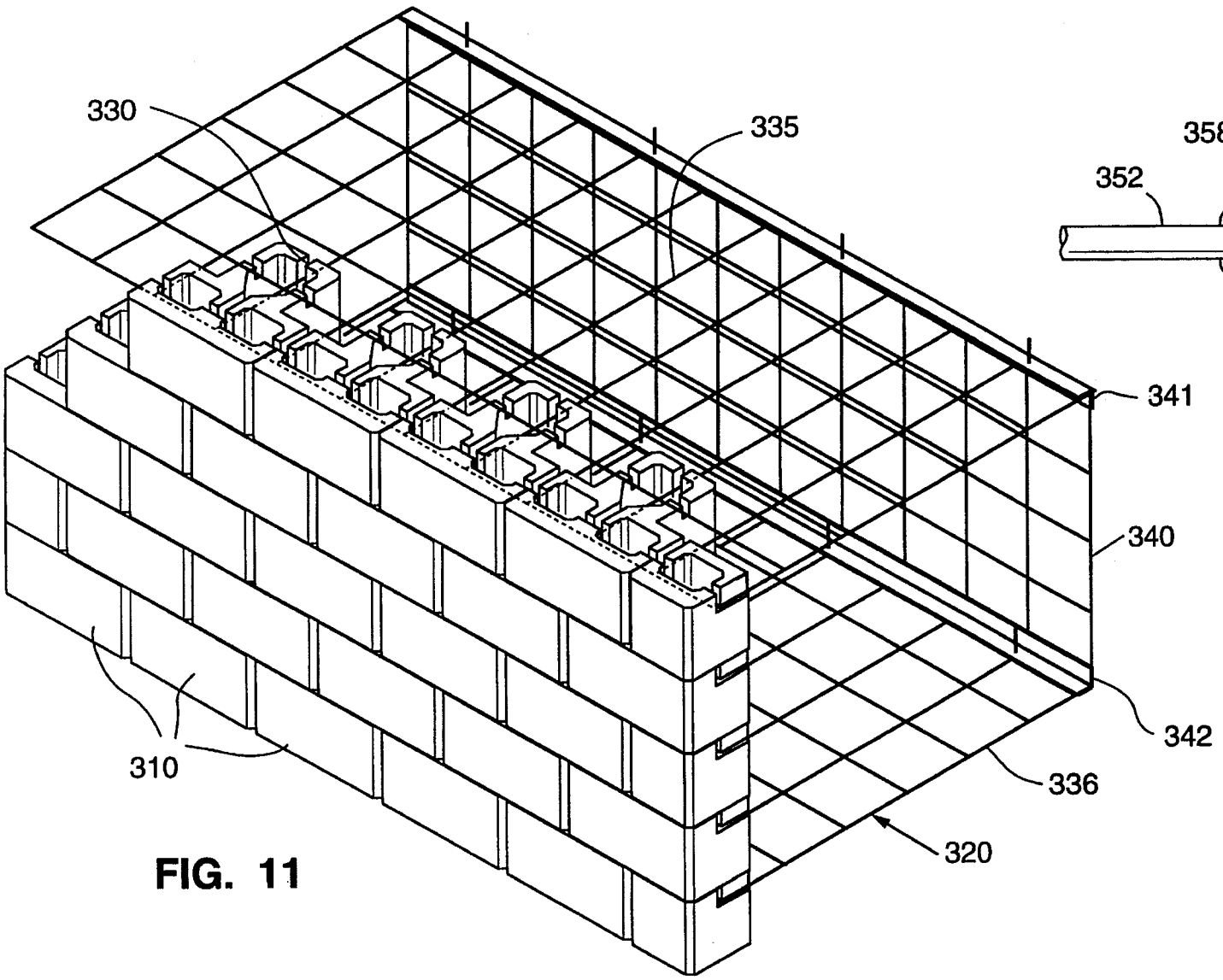
FIG. 11 illustrates another partial, perspective view of the assemblage of another wall structure using modified T-blocks attached to a gabion.

FIG. 11 shows an example of a retaining wall constructed of modified T-blocks 310 and interconnected with a welded wire component that is in the shape of a gabion 320. The welded wire component is composed of a plurality of wire mats assembled into the shape of gabion 320. Gabion 320 may be filled with gabion rock (not shown) or some other material as desired. The modified T-blocks 310 are similar to blocks 110 with the exception of an additional transverse groove 330. Groove 330 enables the modified T-blocks to be connected with blocks such as S-blocks 10, if desired. Also, additional reinforcement is provided by the presence of a transverse wire within groove 330.

Gabion 320 is defined by a pair of horizontal mats 335 and 336, which are coupled to a backing mat 340. A pair of connectors 341 and 342 are used to couple mats 335, 336 and 340 together. An example of the type of connector that may be used as connectors 341 and 342 is shown in FIG. 12.

Figure 12:
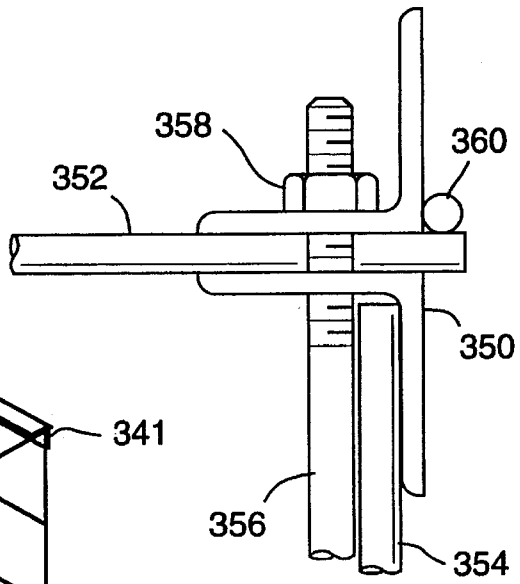
FIG. 12 illustrates an example of a connector used to connect the gabion of FIG. 11 together.

The connector of FIG. 12 employs an angle 350 to which wires 352 and 354 are welded. A threaded bolt 356 and nut 358 may be used as well to sandwich wire 352 between the two legs of angle 350. The connector of FIG. 12 is shown by way of example only. Numerous other types of connectors could be used depending upon the needs of each individual application of the present invention.

Figure 13:
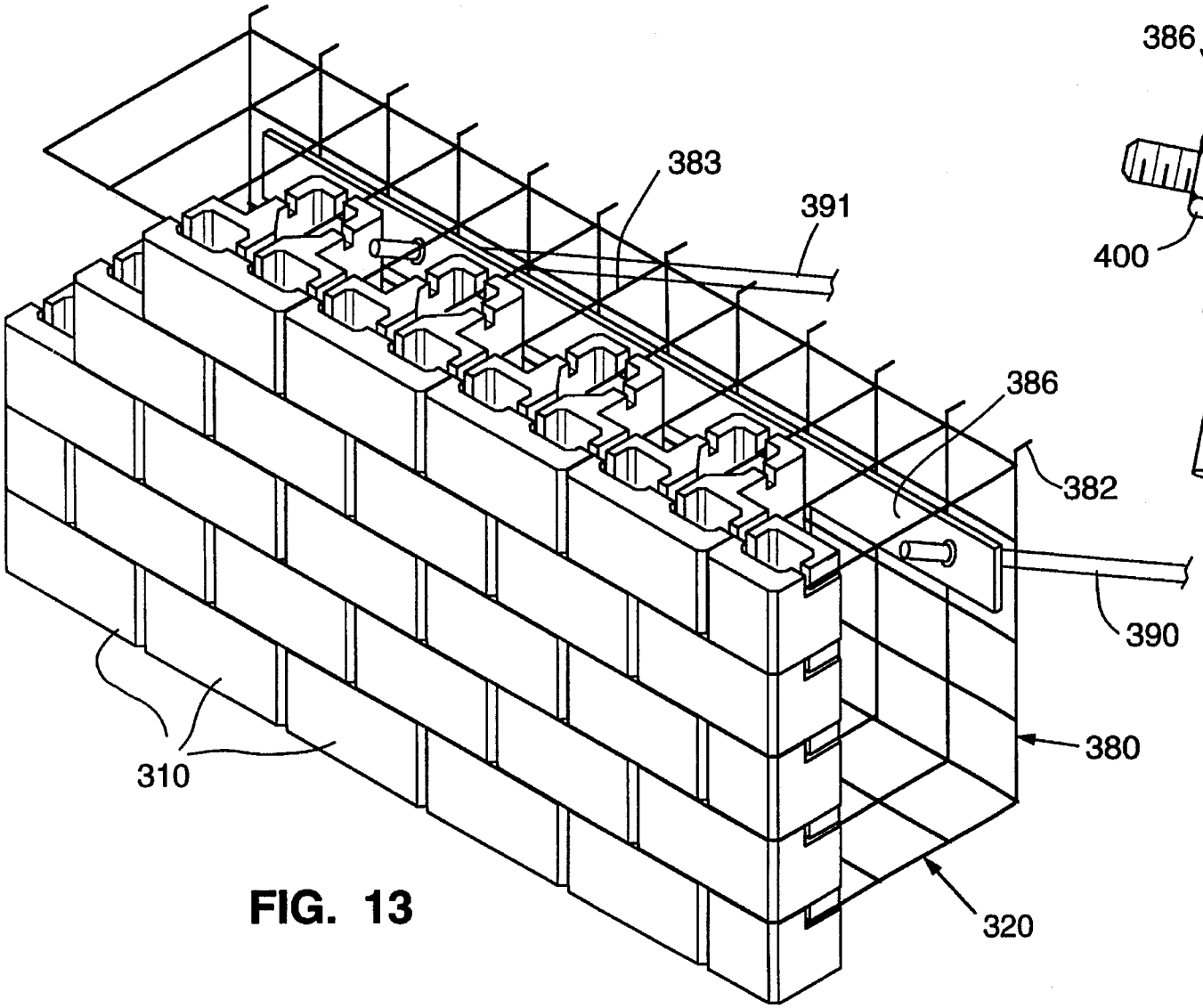
FIG. 13 illustrates another partial, perspective view of the assemblage of another wall structure using modified T-blocks attached to a gabion that is soil nailed.

FIG. 13 illustrates an example of a retaining wall using modified T-blocks and having a soil nailed connection. In a manner similar to that shown in FIG. 11, a group of modified T-blocks 310 are assembled and interconnected with welded wires in the form of a gabion 320. However, unlike the backing mat 340 of FIG. 11, the backing mat 380 of FIG. 13 has a top section 382 which is formed at approximately a 70 degree angle with the rest of the mat 380 and extends away from blocks 310 and into the soil (not shown). The top section 382 serves as a hook for a welded wire mat 383 engaged with the top of the wall formed by the blocks 310. Together, the mats 380 and 383 form a gabion. Although not illustrated, it should be understood that the mat 383 could take an L-shaped form, such as the mat 380, with the section 382 hooked over the corner of the L-shape. With such an arrangement, the wall could be heightened and provided with multiple gabions over its height. A continuous plate 386 is shown connected to backing mat 380. Tie-back rods 390 and 391 are attached to plate 386. This interconnection is illustrated in more detail in FIG. 14.

Figure 14:
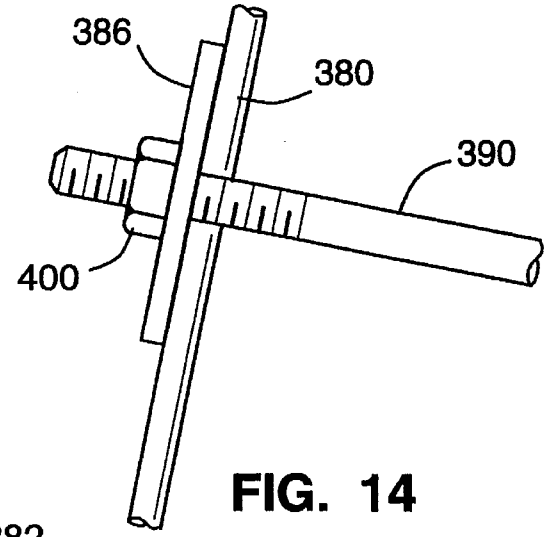
FIG. 14 illustrates an example of a connector used to nail the gabion of FIG. 13 into the soil.

As shown in FIG. 14, rod 390 is bolted to plate 386 via bolt 400. Backing mat 380 is sandwiched in place between plate 386 and the soil (not shown).

Figure 15:
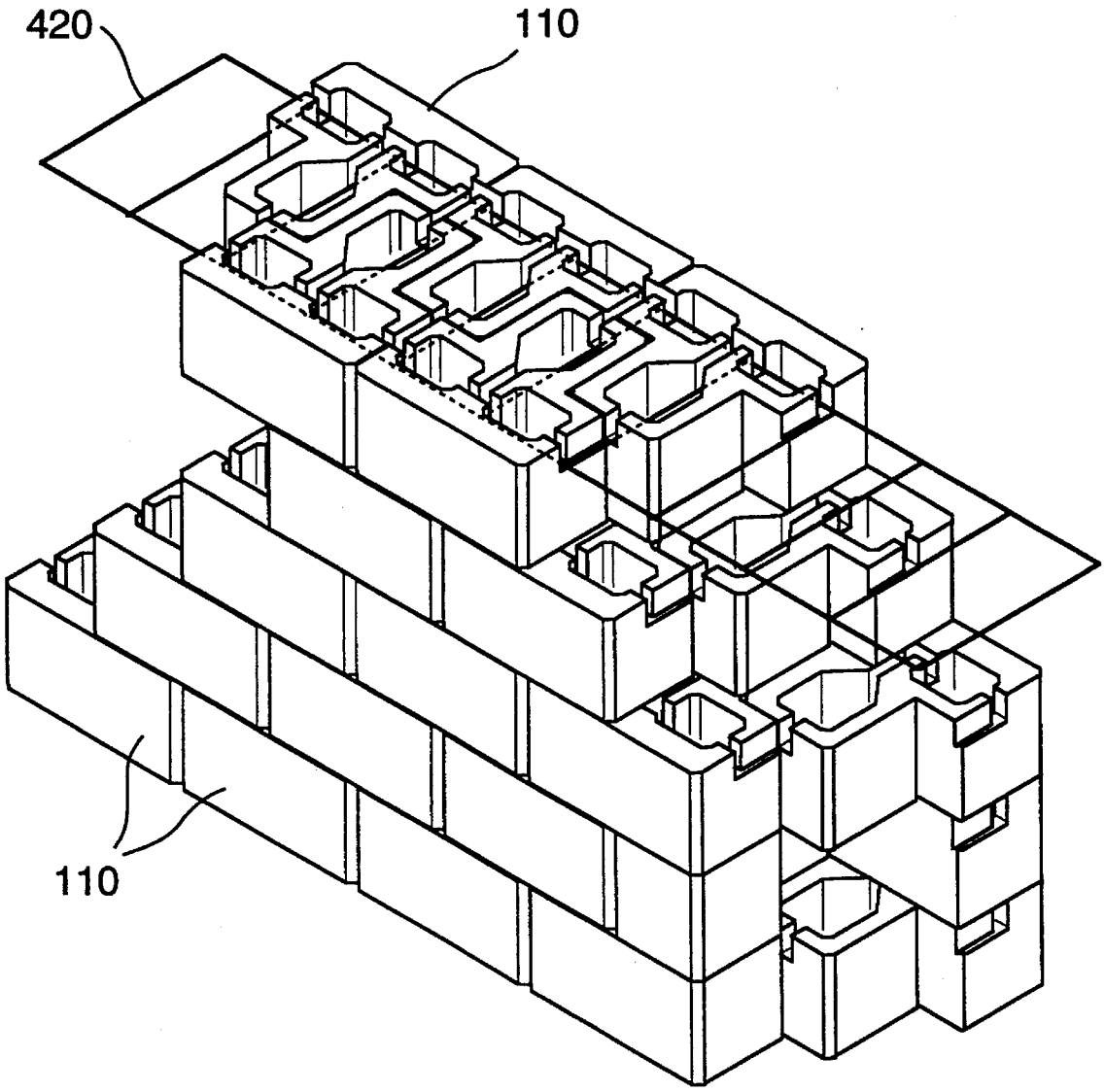
FIG. 15 illustrates another partial, perspective view of the assemblage of a cantilevered wall structure using T-blocks arranged in interlocking fashion and also connected to a welded wire mat.

FIG. 15 illustrates a retaining wall with two columns of T-blocks aligned in an interlocking fashion. If desired, additional blocks could be attached in a similar fashion. Furthermore, if blocks such as modified T-blocks 310 were to be used, then S-blocks could also be connected in an interlocking fashion to increase the width of the wall. The configuration shown provides added stability.

Once the blocks are arranged in the fashion shown in FIG. 15 a welded wire mat 420 is used to interlock with grooves in the blocks. This mat may then be tied back in a manner similar to that shown in FIGS. 11 and 13, if desired. Once again, a medium such as grout or free draining material or steel may be placed within the hollow portions of the blocks of FIGS. 13 and 15 for reinforcement.

FIGS. 16–20 illustrate various structures and methods for erecting a wall. These are particularly useful in situations where very little room is provided for support as is the case where right-of-way restrictions exist. In many cases where these restrictions exist, there is insufficient room to cut back into the soil to place some sort of mechanical stabilization. Therefore, it becomes necessary to drill a hole into the ground behind the wall and insert some sort of reinforcing cage or shaft, which is then filled with concrete.

Figure 16:
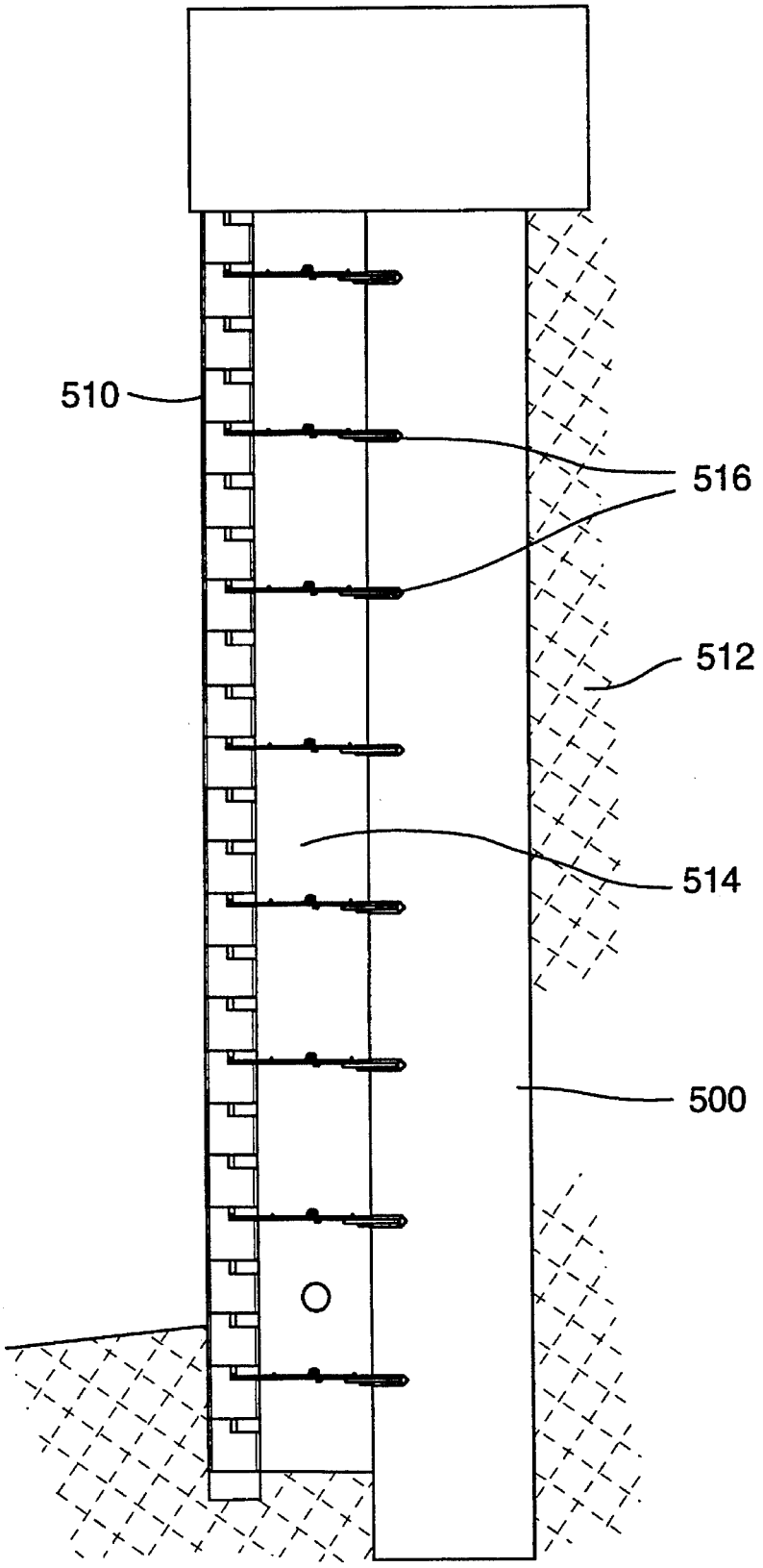
FIG. 16 illustrates a side view of a drilled shaft wall system using the S-blocks of the present invention.

FIG. 16 illustrates a standard veneer wall shown as a plurality of modular S-blocks 510. Although the wall shown is made of modular S-blocks 510, it is to be understood that many other types of walls would be suitable. For example, a concrete panel may be used.

A shaft 500 is disposed between retained fill 512 and free draining material 514 (grout or some other material may be used instead of the free draining material). Shaft 500 is drilled with holes 516 in a number of locations to allow a threaded insert 520 (as shown in FIG. 18) to be placed therein. This can be seen more clearly in the plan view of FIG. 17 and the section view of FIG. 18. The holes may be drilled after shaft 500 has been put in place or may be precast before shaft 500 is put into place.

Shaft 500 may be put in place in a number of ways. One way is to dig a hole in the shape of a column and fill it with concrete. Once the concrete sets, a portion of the ground on one side of the shaft is removed to make room for the retaining wall and welded wire grids.

Figure 17:
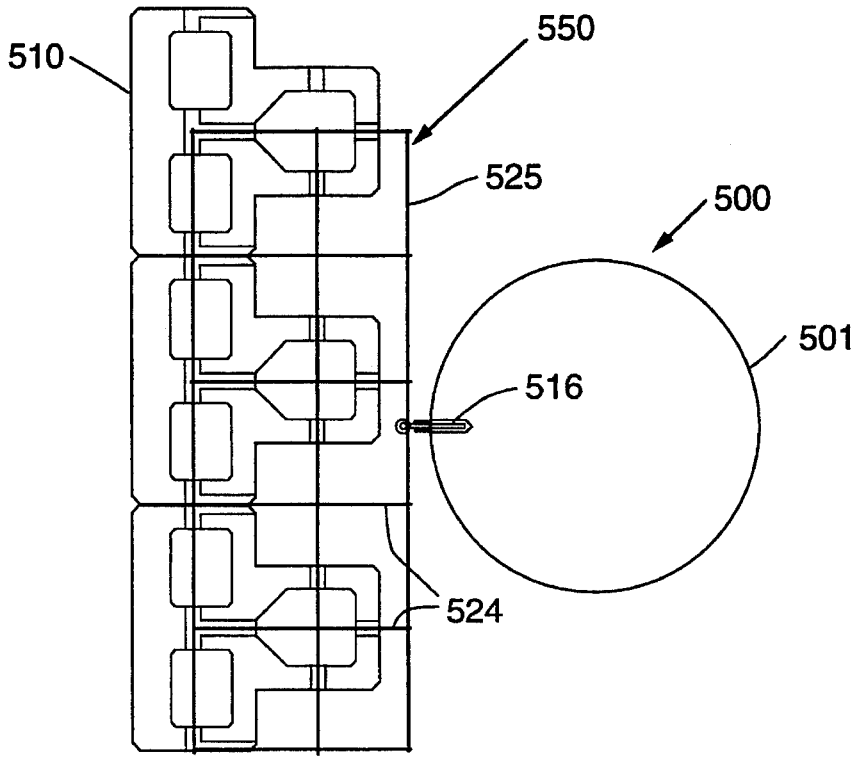
FIG. 17 illustrates a partial, cross-sectional, top view of a drilled shaft wall system similar to that of FIG. 16, but with the addition of the T-blocks of the present invention.
Figure 18:
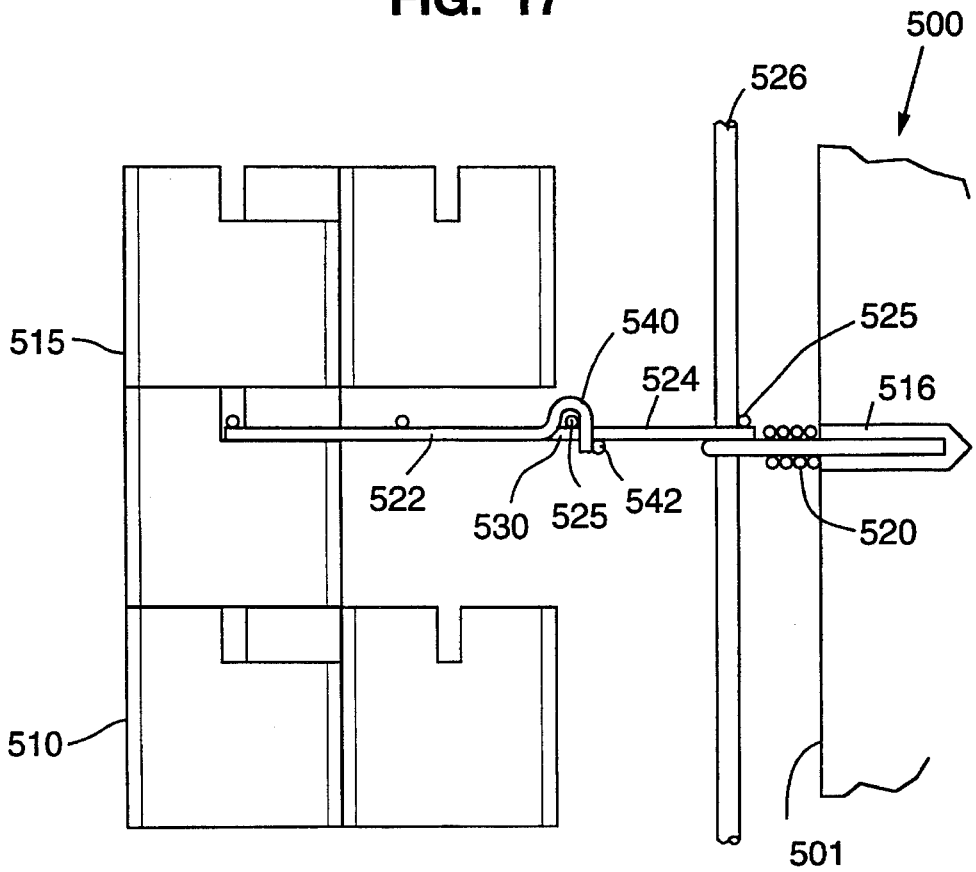
FIG. 18 illustrates a partial side view of the drilled shaft wall system of FIG. 17 in more detail.

FIGS. 17 and 18 illustrates a cross-sectional, top view and a partial, side section view, respectively, of a drilled shaft wall system similar to that of FIG. 16, but with the addition of modular T-blocks 515. Shaft 500 has hole 516 provided in its face 501. A threaded insert 520 is shown within hole 516. The threaded insert 520 may be one of a number of inserts readily available in the marketplace. The insert is provided with some sort of loop or eye-bolt through which a reinforcing bar 526 may be passed. Reinforcing bar 526 may be passed through any number of inserts 526 as long as they are vertically aligned. Reinforcing bar 526 acts to connect the threaded insert 520 with a tyladder made up of longitudinal wires 524 and transverse wires 525. The term "tyladder" is used throughout this specification to refer generally to a rectangular welded wire grid. As shown in FIG. 18, reinforcing bar 526 catches one of the transverse wires 525 (shown to the right of reinforcing bar 526), thereby locking it to threaded insert 520. Threaded insert 520 can be inserted into shaft 500 by a variable amount. This allows some flexibility when attempting to make a connection with the reinforcing bar 526.

A T-clip 522, having a curved portion 540 at its distal end, is connected to tyladder 550 by a connection pin 530. T-clip 522 has a transverse wire 542 which is positioned below longitudinal wire 524. Preferably, both tyladder 550 and T-clip 522 are manufactured from welded wire grids. This type of connection may be seen in FIG. 17 of U.S. Pat. No. 4,993,879, by William K. Hilfiker, one of the inventors herein.

Another example of a connector for securing soil reinforcing elements to retaining wall panels is disclosed in U.S. Pat. No. 4,993,879, to William K. Hilfiker, one of the coinventors of the present invention.

Alternatively, it is possible to use a single welded wire grid. However, this would be more difficult to assemble because the tolerances would have to be much closer for a proper fit.

Figure 19:
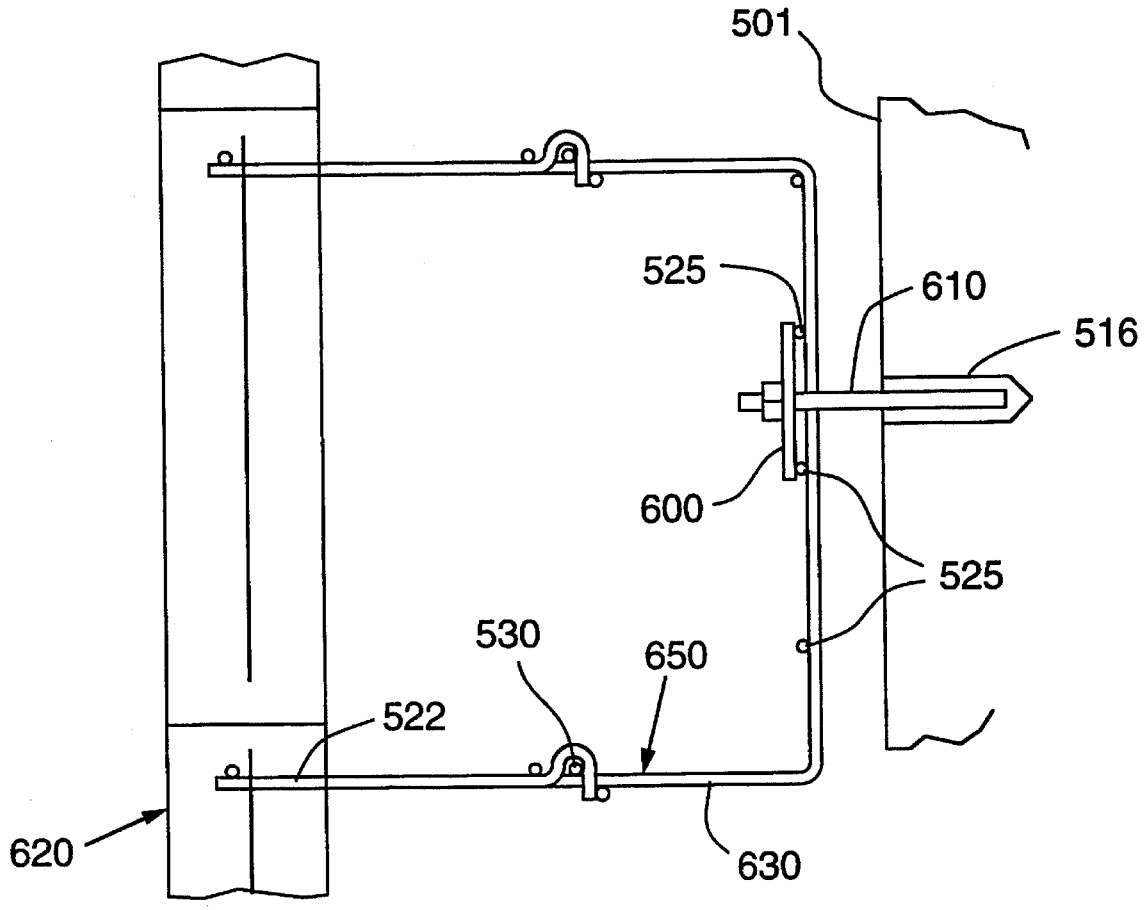
FIG. 19 illustrates a partial side view of another drilled shaft wall system employing a connection plate.

Another embodiment of the shaft connection is shown in FIG. 19. Wherever appropriate, like numerals have been used to identify elements similar to those in FIG. 18. The embodiment shown in FIG. 19 employs a connection plate 600 to frictionally engage some of the transverse wires 525 of the tyladder 650. Connection plate 600 is connected to an insert 610, which protrudes from the face 501 of shaft 500. Tyladder 650 is different from the tyladder 550 of FIG. 18. Specifically, tyladder 650 is arranged in the form of a C-basket having a C-shaped wire grid 630 and a plurality of transverse wires 525.

As shown in FIG. 19, connection plate 600 should engage at least two of the transverse wires 525 of the tyladder 650 in order to provide support for the wall 620. Thus, the connection plate in effect locks tyladder 650 to insert 610. Wall 620 is shown as a concrete panel instead of a plurality of blocks. It is to be understood that the concrete panel shown can be replaced with a wall similar to that shown in FIGS. 16–18.

The arrangement of FIG. 19 is less critical than that shown in FIG. 18, because alignment is not as great an issue. In other words, it is easier to have connection plate 600 frictionally engage transverse wires 525 than it is to have a reinforcing bar 526 pass through a tyladder 550 and a threaded insert 520.

Tyladder 650 is interconnected with a T-clip 522 in a manner similar to that shown and described in FIG. 18. That disclosure is hereby incorporated by reference.

While the present invention has been described with particular reference to the preferred embodiments, one of ordinary skill in the art would be enabled by the disclosure to make various modifications these embodiments and still be within the scope and spirit of the present invention as embodied in the appended claims.

What is claimed is:

1. A retaining wall system for an earthen formation comprising:

a plurality of modular blocks having a transverse groove formed in a top surface thereof, said blocks being assembled in generally horizontal rows and vertically stacked with the transverse grooves in certain adjacent blocks within each row aligned; and a welded wire component attached to said certain blocks to lock said certain blocks together transversely and provide a connection therefor to one side of the blocks, the welded wire component having a plurality of longitudinal and transverse wires, wherein one or more of the transverse wires extends through the aligned transverse grooves of said certain blocks and said longitudinal wires extend laterally to one side of said certain blocks for embedment in an earthen formation substantially adjacent the retaining wall.

2. The retaining wall system according to claim 1, wherein the modular blocks also have longitudinal grooves in the top surface thereof in intersecting relationship to the transverse grooves for extension of the longitudinal wires therethrough.

3. The retaining wall system according to claim 1, wherein some of the modular blocks are T-shaped, the T-shaped blocks having three hollow sections extending vertically therethrough, at least certain of said hollow sections vertically overlapping when the blocks are assembled in generally horizontally disposed vertically stacked rows.

4. The retaining wall system according to claim 1, wherein some of the modular blocks are generally rectangular and have hollow sections extending vertically therethrough, at least certain of said hollow sections vertically overlapping when the blocks are assembled in generally horizontally disposed vertically stacked rows.

5. The retaining wall system according to claim 1, wherein the welded wire component is composed of a plurality of wire mats assembled to form a gabion, the gabion being located behind the plurality of modular blocks with one side of the gabion being defined by the blocks.

6. The retaining wall system according to claim 5, wherein the plurality of wire mats includes a pair of horizontal mats coupled with a backing mat.

7. The retaining wall system according to claim 5, further comprising means for securing the gabion to an earthen formation.

8. A retaining wall system comprising:

a plurality of modular blocks assembled in rows and being vertically stacked, each modular block of the plurality of modular blocks having a transverse groove formed in a top surface thereof;

a welded wire component attached to certain ones of the plurality of modular blocks, the welded wire component having a plurality of longitudinal and transverse wires, wherein one or more of the transverse wires interconnects with the transverse groove of each of the certain ones of the plurality of modular blocks; and, means for securing the welded wire component to a shaft located behind the plurality of modular blocks.

9. The retaining wall system according to claim 8, wherein the means for securing the welded wire component to the shaft includes:

an insert connected to the shaft;

a reinforced bar passing through the insert, the reinforcing bar engaging the welded wire component so as to lock the welded wire component to the insert.

10. The retaining wall system according to claim 8, wherein the means for securing the welded wire component to the shaft includes:

an insert connected to the shaft;

a connection plate attached near an end of the insert; the connection plate frictionally engaging at least two of the transverse wires of the welded wire component such that the welded wire component is locked at a certain distance from the shaft.

11. The retaining wall system according to claim 8, wherein the welded wire component includes a T-clip interconnected with a tyladder.

12. A retaining wall system comprising:

a wall having a front face and a rear face;

a shaft located behind the rear face of the wall;

a welded wire mat connected to the wall and extending from the rear face of the wall; and, means for connecting the welded wire mat to the shaft; including:

a threaded insert secured to the shaft, a reinforcing bar passing through the threaded insert and also being connected to the welded wire mat so as to lock the welded wire mat to the threaded insert.

13. The retaining wall system according to claim 12, wherein the welded wire mat includes a tyladder connected to a T-clip by means of a connection pin.

14. The retaining wall system according to claim 12, wherein the wall is a concrete panel.

15. The retaining wall system according to claim 11, wherein the wall is made up of a plurality of modular concrete blocks.

16. The retaining wall system according to claim 14, wherein the shaft is generally cylindrical, hollow and made of concrete.

17. The retaining wall system according to claim 16, wherein the shaft is filled with concrete.

18. A retaining wall system comprising:

a wall having a front face and a rear face;

a shaft located behind the rear face of the wall;

a welded wire mat connected to the wall and extending from the rear face of the wall;

means for connecting the welded wire mat to the shaft; and, wherein:

the welded wire mat includes a first mat in the shape of a T-clip and a second mat in the shape of a C-basket, the C-basket includes a plurality of transverse wires, the means for connecting the welded wire mat to the shaft includes a connection plate attached to an insert which protrudes from the shaft, the connection plate frictionally engages some of the transverse wires of the C-basket to as the secure the welded wire mat to the shaft.

19. The reinforcing wall system according to claim 18, wherein the wall is a concrete panel.

20. In a retaining wall system having a concrete wall attached to a plurality of wire mats, generally lying in a horizontal plane and being vertically spaced from one another, a concrete shaft disposed behind the concrete wall, and a means for securing the plurality of wire mats to the concrete shaft, wherein the shaft is provided with plurality of holes, the means for securing comprising:

a threaded insert provided within certain ones of the holes;

a reinforcing bar passing through at least one of the threaded inserts, the reinforcing bar also engaging at least one of the wire mats to lock said one of the wire mats to said one of the threaded inserts, thereby supporting the retaining wall in a fixed position relative to the shaft; and, wherein each of the wire mats is formed by a first mat and a second mat that are coupled to one another by means of a connection pin, the first mat being connected to the wall and forming a T-clip and the second mat being a tyladder which is engaged by the reinforcing bar.

21. A retaining wall system comprising:

a plurality of modular blocks assembled in rows and being vertically stacked, each modular block of the plurality of modular blocks having a transverse groove formed in a top surface thereof;

a welded wire component attached to certain ones of the plurality of modular blocks, the welded wire component having a plurality of longitudinal and transverse wires, wherein one or more of the transverse wires interconnects with the transverse groove of each of the certain ones of the plurality of modular blocks; and wherein:

the welded wire component is composed of a plurality of wire mats assembled to form a gabion, the gabion being located behind the plurality of modular blocks;

the plurality of wire mats includes a pair of horizontal mats coupled with a backing mat; and, the backing mat has a continuous plate attached thereto and wherein the means for securing the gabion to an earthen formation includes a tie-back rod attached to the plate and extending into the earthen formation.

* * * * *